US005775316A

United States Patent [19]

Jones

[11] Patent Number: 5,775,316

[45] Date of Patent: Jul. 7, 1998

[54] COOKING RANGE WITH INTERCHANGEABLE GRATE AND WOK RING

[75] Inventor: Richard R. Jones, St. Louis, Mo.

[73] Assignee: Rawkin-Delux, Inc., Santa Fe Springs, Calif.

[21] Appl. No.: 632,619

[22] Filed: Apr. 15, 1996

[51] Int. Cl.[6] ..... A47J 37/00; F24C 3/00

[52] U.S. Cl. ..... 126/41 R; 126/50; 126/215; 126/216

[58] Field of Search ..... 126/41 R, 39 R, 126/39 J, 39 K, 38, 211, 216, 40, 50, 214 R, 215, 214 A; 248/146

[56] References Cited

U.S. PATENT DOCUMENTS 616,521 12/1898 Birkicht ..... 126/215
2,845,056 7/1958 Chambers ..... 126/214 R
5,044,352 9/1991 Lok ..... 126/39 K
5,315,983 5/1994 Law ..... 126/50
5,345,062 9/1994 Maudal ..... 126/215
5,632,265 5/1997 Koziol ..... 126/50

*Primary Examiner*—James C. Yeung
*Attorney, Agent, or Firm*—G. Donald Weber, Jr.

[57] ABSTRACT

A cooking range, especially useful in commercial and domestic environments, wherein a grate and a wok ring are interchangeably mounted thereon. The range supports the wok ring and the grate over a gas fired burner element. The grate and the wok ring include a support plate which selectively engages the cooking range in a preferred orientaton. The wok ring includes a preferred configuration of the support ring.

18 Claims, 2 Drawing Sheets

COOKING RANGE WITH INTERCHANGEABLE GRATE AND WOK RING

BACKGROUND

1. Field of the Invention

This invention relates, generally, to cooking ranges and, more particularly, to a range wherein grates and wok rings are interchangeably mounted thereon.

2. Prior Art

There are many cooking ranges known in the art. These ranges include electric and gas fired ranges. The ranges can be for domestic use, e.g. use in the home, or for commercial use, e.g. use in restaurants or the like.

In the case of commercial use, the ranges are usually gas fired for a number of reasons including easier and quicker temperature control. That is, the flame and, therefore, the temperature achieved can be adjusted virtually instantaneously with gas-fired ranges. Moreover, the adjustments of gas ranges can frequently be more finely controlled.

Many commercial establishments, e.g. restaurants, are expanding their menus and style of cuisine. One item frequently added to the repertoire of restaurants is oriental-style cooking. To accomplish this type of cooking, the restaurants frequently cook on woks.

Typically, a wok is a generally hemispherical cooking utensil which does not sit conveniently on a conventional gas burner or grate in a gas-fired range. Typically, a range or cooking station for a wok often utilizes a ring which is in the form of a rod which has been bent into a circular configuration. Thus, the wok station could not be converted to a grate station (or vice versa) readily and easily. In the past, to accomodate a wok, a restaurant had to have a special cooking range therefor. Alternatively, the conventional range could be adapted to accomodate a wok but only at the expense of a conventional cooking station (or grate) on the range. Thus, depending upon orders from diners, the range could become rather limitative in terms of cooking spaces available to the cooking staff.

SUMMARY OF THE INSTANT INVENTION

A cooking range, especially useful in commercial environments, wherein a grate and a wok ring are interchangeably mounted thereon to permit easy conversion of cooking stations. The wok ring includes a preferred configuration but fits in the same space as a grate. The range supports the wok ring and the grate over a gas fired burner element to permit flexibility in cooking techniques.

DESCRIPTION OF A PREFERRED EMBODIMENT

Figure 1:
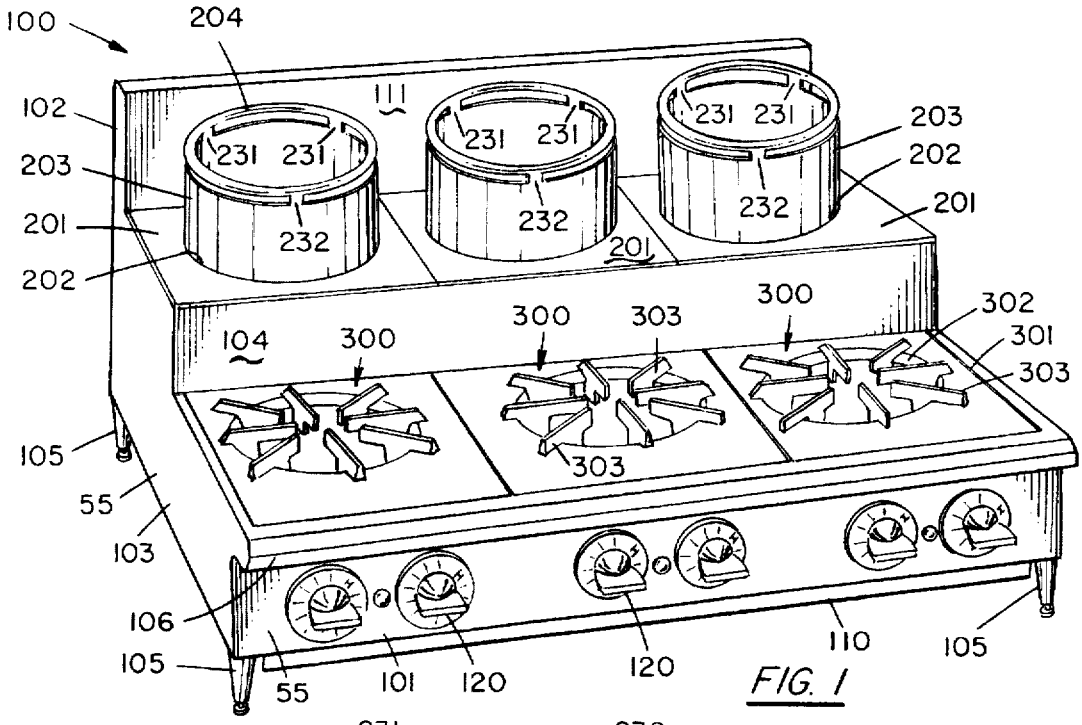
FIG. 1 is a front perspective illustration of one embodiment of the range of the instant invention having multiple cooking stations.

Referring now to FIG. 1, there is shown a front perspective view of one embodiment of the cooking range 100 of the instant invention. In this embodiment, the range 100 includes a plurality of levels or tiers of cooking stations and a plurality of cooking stations per tier. It must be understood that the range can have any number of tiers and/or stations per tier. A cooking range comprising a single cooking station is contemplated.

In the embodiment shown, the range 100 comprises a frame which includes a front panel 101, a back panel 102 and side panels 103 (only one of which is shown in FIG. 1). Typically, the front and side panels are fabricated of stainless steel as is the front nosing 106. The nosing 106 can be fabricated separately or as an integral part of front panel 101. The back panel 102 and the remainder of the cabinet structure is fabricated of aluminized steel. The riser 104 and the back splash surface 111 are, typically, fabricated of black oxide stainless steel. The support structure (not shown), including legs 105, is fabricated of heavy gauge steel or the like.

In the embodiment shown in FIG. 1, six (6) cooking stations are provided in two (2) tiers. The cooking stations are illustrated by three (3) wok rings 200 and three (3) grates 300. The wok rings and the grates are fabricated individually whereby they can be used interchangeably. For example, some or all of the wok rings 200 can be replaced by grates 300, and vice versa.

The grates 300 are fabricated of heavy cast iron. In the preferred embodiment, each grate 300 includes a support plate 301 with a large aperture 302 therethrough. A plurality of support fingers 303 extend from the support plate inwardly toward the center of the aperture 302. The fingers 303 are used to support a cooking vessel (not shown) over the aperture 302 which is adapted to be aligned with the gas burner (see infra) at the cooking station.

Each wok ring 200 includes a support plate 201 which is substantially similar to support plate 301 of the grate 300 and includes a large aperture 202 therethrough. A cylinder 203 fabricated of rolled stainless steel extends above and below the support plate 201. The cylinder 203 is, preferrably, a single piece which is passed through the central aperture 202 in the support plate 201 and affixed thereto by welding, or the like. A ring 204 formed of stainless steel rod is mounted to the top edge of cylinder 203 by a plurality of tabs. In particular, the front tab 232 is somewhat shorter than the rear tabs 231. Thus, the ring 204 slants slightly downwardly toward the front of the wok ring 200.

A drip pan 110 is mounted beneath the full width of the range and is easily removed for cleaning. Typically, the drip pan slides in and out of the range on suitable slides or runners.

The valve knobs 120 are mounted on the front panel 101. A separate valve (see infra) and valve knob is provided for each cooking station. The valve knobs 120 are connected to conventional smooth action valves which provide for maximum heat control.

Figure 2:
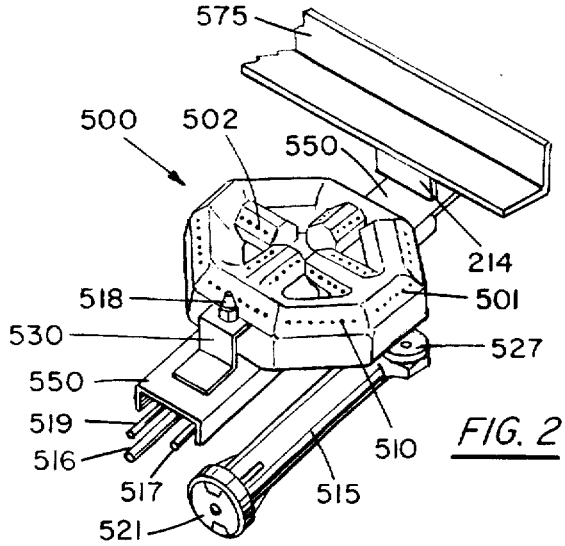
FIG. 2 is a partial view of a cooking station used in ranges defined by the instant invention.

Referring now to FIG. 2, there is shown a partial view of a gas burner 500 of the type used at each cooking station. The burner 500 is fabricated of heavy cast iron. One typical example of the burner 500 is rated at 30,000 Btu (Natural Gas). The burner 500 includes an outer ring 501 which, in this embodiment, includes eight (8) serially connected, hollow segments which define a generally octagonal configuration. This configuration provides a "circle" flame pattern. In addition, a plurality of hollow internal arms 502 extend inwardly from the outer ring 501. The internal arms 502 form a "cross" flame pattern. Typically, the ring and the arms have a common plenum which is connected to the gas source.

The outer ring segments and the internal arms all have a flat upper surface and angled surfaces adjacent thereto. A plurality of apertures 510 pass through the angled surfaces adjacent the upper surface of the burner. The cooking gas passes through the common plenum and out the apertures 510 where it is ignited to provide the flame for cooking. The combination of the "cross" and "circle" flame patterns provides an even distribution of the heat pattern at the cooking station.

The burner ring 501 is mounted on support bracket 550 which extends beneath the burner. In the preferred embodiment, the support bracket 550 is formed in an inverted U-shape configuration. The bracket 550 overlies and protects the pilot light (igniter) gas line 516. In a multi-tier unit (see FIG. 4), the igniter gas line 519 and the gas supply line 517 for the rear cooking station are also mounted under the forward support bracket 550.

The igniter 518 is supported in bracket 530 which is attached to support bracket 550. In the preferred embodiment, the igniter 578 is constantly "on" to provide "instant on" operation of the range.

The venturi 515 is connected in-line with the burner 501 to control the flow of gas from the gas line (see infra) to the burner 500. Shutter 521 is adjusted to control the air/gas mixture supplied to the burner 501 (as may be required by the use of natural gas, propane or the like). The gas inlet coupler 515 (or venturi) is connected to the burner 501 at junction 527 which, typically, includes a gasket (not shown). The control knob, valve and orifice are omitted from FIG. 2 for clarity.

The support bracket 550 is connected, for example, by welding, to the support rail 575. The support rail 575 is joined to and forms a part of the structure of the range 100. In this embodiment, the support rail 575 is L-shaped and operates to support the back edge of the support for the grate 300 or the work ring 200, as will be described infra. A stop 214 is provided at the front lip of the support rail 575 to prevent improper insertion of the plate of the grate 300 or the wok ring 200 as described hereinafter. In one embodiment, the stop 214 comprises a small plate welded to the lower lip of support rail 575.

Figure 3:
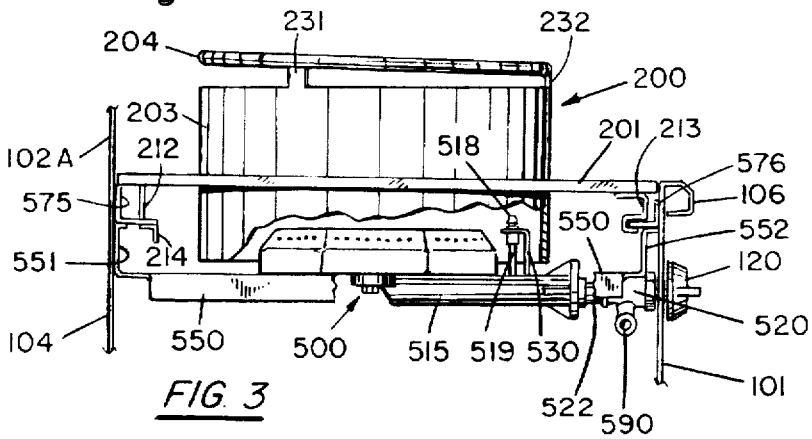
FIG. 3 is a partially broken away elevation view of the range of the instant invention.

Referring now to FIG. 3, there is shown a partially broken away, elevation view of a cooking station with a wok ring 200 installed. In this illustration, the support bracket 550 is mounted between the front panel 101 and a rear panel 102A. The rear panel 102A can be the rear panel 102 (in a single tier range) or, alternatively, an intermediate panel in the case of a range with multiple tiers of cooking stations. The back panel 102A can also be replaced by or supplemented by the support rail 575.

The gas burner 500 is mounted on the support bracket 550 along with the pilot burner bracket 530. The pilot burner 518 is supported in the bracket 530.

The back (or interior) end 551 of support bracket 550 is attached to the support rail 575. The support rail 575, typically an angle iron component, can be mounted (e.g. welded or bolted) onto the back panel 102A. Alternatively, the rail 575 can be suspended in the range superstructure. The front end 552 of support bracket 550 is attached to the support rail 576. The support rail 576, typically an angle iron component similar to back support rail 575, can be mounted on the front panel 101 or on the skeletal support structure of the range.

The support plate 201 for a wok ring 200 (or the support plate 301 for a grate 300) has a rear support 212 attached thereto. In one embodiment, rear support 212 is an L-shaped (or angle-iron) support with one leg welded to the underside of plate 201. The other leg depends from the support plate and is adapted to rest on the support rail 575.

A locking support 213 is attached to the front edge of support plate 201 of wok ring 200 (or support plate 301 of grate 300). The locking support 213 has a, generally, reverse S-shaped configuration. Thus, the support 213 can engage and interlock with the front support rail 576 which is mounted on the inside surface of front panel 101. In particular, the lower, open portion of the locking (or interlocking) support 213 receives the horizontal lip of the support rail 576. The upper, vertical leg of the locking suport 213 rests on the support rail 576. Typically, the vertical leg of the locking support 213 is the same length as the rear support 212. Thus, when the rails 575 and 576 are properly aligned, the plate 201 (or 301) is maintained horizontal and level.

However, it is clear that the locking support 213 cannot engage the rear support rail 575. That is, the stop 214 extends below support rail 575. Thus, stop 214 interferes with and blocks the lower horizontal lip of locking support 213. Inasmuch as the locking support 213 cannot engage support rail 575 (as it does with support rail 576), the support plate is prevented from seating properly on the support rail 575. This arrangement assures that the front of the assembly (i.e. grate 300 or wok ring 200) is directed to the front of the range. Of course, this condition is of primary concern relative to the wok ring 200 which includes the sloped support ring 204.

The grate 300 (see FIG. 1) also includes support brackets equivalent to brackets 212 and 213. Thus, a grate 300 can be used instead of the wok ring 200. Therefore, the grate 300 and the wok ring 200 are completely interchangable. This interchangability permits the utilization of a range with up to four (4) wok rings in the same space previously required for a single wok range.

The cylinder 203 extends through the support plate 201 and is welded thereto. The bottom of cylinder 203 effectively surrounds the burner 500 and may nearly reach the support bracket 550 to thereby provide efficient operation in the wok ring 200. In the preferred embodiment, the cylinder 203 extends slightly further above the support plate 201 than below. In one example, the cylinder 203 extends about 2½ inches above support plate 201 and about 2 inches below the plate. Of course, these dimensions are examples and are not intended to be limitative.

The ring support 204 is affixed to the tabs 231 and 232 which extend upwardly from the upper end of the cylinder 203. The rear tabs 231 are slightly longer than the front tab 232 whereupon the support ring 204 defines a slight rear-to-front downwardly slope.

The valve knobs 120 on the front panel 101 are connected to the valve 520 to control the gas flow from the gas line 590 to the burner 500. The gas line 590 is securely mounted in the range chassis and is connected directly to the gas main in any suitable fashion. The valve 520 is connected to the venturi 515 via a conventional orifice 522 and, perhaps, other suitable fittings.

Likewise, the pilot burner line 519 is also connected to the gas line 590. The pilot burner 518 is, in this embodiment, always "on". Thus, no igniter control is shown. However, with a slight modification, the igniter can be converted to a "demand" control system.

A suitable nosing 106 is shown attached to the range. The nosing is primarily decorative and can be replaced by an extended nosing which serves as a support tray or the like.

Figure 4:
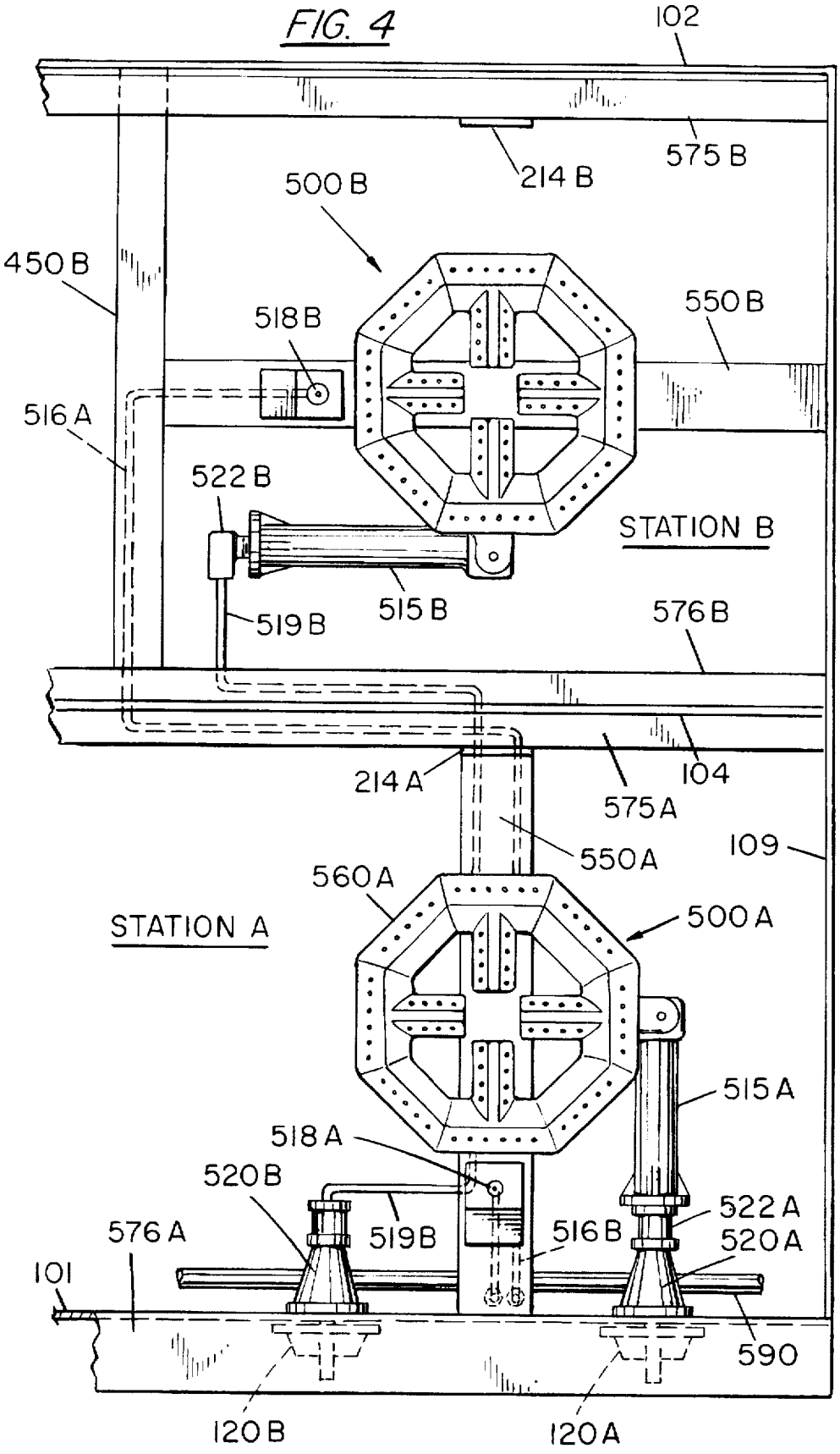
FIG. 4 is a representational plan view of a multi-tier, multi-station range in accordance with the instant invention.

Referring now to FIG. 4, there is shown a plan view of a layout of a multi-tier, multi-station range in accordance with the instant invention. Station A and Station B are shown. In particular, Station A is a front, lower cooking station while Station B is a rear, upper station (see FIG. 1, for representative station alignment).

The front panel 101, rear panel 102 and riser panel 104 are shown arranged as in FIG. 1. Side panel 109 is the side panel opposite to side panel 103. A suitable support frame (not shown) can be provided in order to provide the structural support for the range.

The front support rails 576A and 576B and rear supprt rails 575A and 575B are connected to and supported by the frame and/or side panels. As is seen, the burner support 550A is joined to the support rails 575A and 576A in the manner described supra. However, the burner support 550B (of Station B) is rotated 90° (relative to the burner support 550A) and is joined to side panel 109 and a cross-over support strap 450B. This arrangement provides a better pattern for strength and rigidity for the range, in general, and for Station B, in particular.

As described supra, the venturis 515A and 515B are connected to the respective burners 500A and 500B and mounted beside the respective burner supports. Likewise, the respective pilot burners 518A and 518B are mounted on the respective supports 550A and 550B adjacent to the respective burners 500A and 500B.

It is seen that the pilot feed tubes 516A and 516B (typically copper tubing) are connected from the main gas feed line 590 to the respective pilot burners 518A and 518B. The pilot feed tubes are placed under the burner supports 550A and 550B (within the channel formed thereby). The front pilot tube terminates at the front pilot burner 518A. The rear pilot tube 516B continues under the burner support 550A. The tube 516B is positioned under the rail 576, under the support strap 450B and under the rear burner support 550B to the pilot burner 518B.

The gas feed tubes 519A and 519B (typically aluminum tubing of appropriate length and configuration) are connected between the gas valves 520A and 520B and the respective orifices 522A and 522B. (The gas feed tube 519B, similar to the pilot tube, is also positioned under burner support 550A, rail 576 and support strap 450B.) The orifices are connected to the respective venturis 515A and 515B. Thus, gas is fed from the main gas line 590 to the control valves 520A and 520B. When the control knob 120 is rotated, the valve 520 is opened and gas flows through the orifice 522 into the venturi 515 and, thence, into the burner 501. (This operation occurs at each cooking station as well.)

It is noted that support rails 576B and 575B are the equivalent of rails 576A and 575A. Thus, the plates 200 or 300 are mounted thereon in the same fashion. That is, the interlock bracket 213 engages the front rail 576. Also, the stop 215A or 214B at rail 575A or 575B, respectively prevents the improper mounting of the support plate of the respective cooking stage.

Thus, there is shown and described a unique design and concept of cooking range with interchangable grates and wok rings. As noted, a grate 300 can replace a wok ring 200 and vice versa. This interchangability reduces the amount of space required in cooking ranges and, thus, makes such ranges much more economical to use. Moreover, the convertability of this range permits use thereof as a standard range when doing preparation cooking and then converting to a wok range at serving time. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A cooking range comprising, a support frame, a support plate adapted to be mounted on said support frame, said support plate including at least one of a grate means and a wok ring means integrally formed therewith, and interlocking support means mounted on said support plate, said interlocking support means adapted to selectively engage with said support frame in order to permit said support plate to be mounted on said support frame in a selected orientation.

2. The range recited in claim 1 including, stop means attached to said support frame to prevent said interlocking means from being able to improperly engage with said support frame.

3. The range recited in claim 1 wherein, said support frame includes a horizontal support rail, and said interlocking support means includes a reverse S-shaped support which engages said horizontal support rail.

4. The range recited in claim 1 including, burner means mounted on said support frame adjacent to said support plate.

5. The range recited in claim 4 including, gas supply means connected to said burner means.

6. The range recited in claim 5 including, control means for selectively permitting said gas supply means to supply gas to said burner means.

7. The range recited in claim 6 including, igniter means mounted on said support frame adjacent to said burner means in order to ignite gas supplied to said burner means.

8. The range recited in claim 6 wherein, said control means includes a shut-off valve and an orifice.

9. A cooking range comprising, a support frame, said support frame includes at least one horizontal support rail, a support plate adapted to be mounted on said support frame, burner means mounted on said support frame adjacent to said support plate, and interlocking support means mounted on said support plate, said interlocking support means includes a reverse S-shaped support which engages said horizontal support rail, said interlocking support means adapted to selectively interlock with said support frame in order to permit said support plate to be mounted on said support frame adjacent to said burner means in a selected orientation.

10. The range recited in claim 9 including, grate means formed on said support plate.

11. The range recited in claim 9 including, wok ring means formed on said support plate.

12. The range recited in claim 11 wherein, said wok ring means includes a cylinder which extends through said support plate.

13. The range recited in claim 12 wherein, said wok ring means includes a support ring on the top end of said cylinder.

14. The range recited in claim 13 wherein, said support ring is mounted to slope slightly relative to said cylinder.

15. The range recited in claim 14 including, stop means attached to said support frame to prevent said interlocking means from being able to improperly engage with said support frame.

16. The range recited in claim 14 including, gas supply means connected to said burner means.

17. The range recited in claim 14 including, control means for selectively permitting said gas supply means to supply gas to said burner means.

18. The range recited in claim 14 including, igniter means mounted on said support frame adjacent to said burner means in order to ignite gas supplied to said burner means.

* * * * *